US007726128B2

(12) United States Patent
Oser et al.

(10) Patent No.: US 7,726,128 B2
(45) Date of Patent: Jun. 1, 2010

(54) APPARATUS AND METHOD FOR CONVERTING HEAT ENERGY TO MECHANICAL ENERGY

(75) Inventors: Erwin Oser, Cologne (DE); Michael Rannow, Lennestadt (DE)

(73) Assignee: Ecoenergy Patent GmbH, Darmstadt (DE)

( * ) Notice: Subject to any disclaimer, the term of this patent is extended or adjusted under 35 U.S.C. 154(b) by 628 days.

(21) Appl. No.: 10/583,936

(22) PCT Filed: Dec. 22, 2004 (Under 37 CFR 1.47)

(86) PCT No.: PCT/EP2004/053650

§ 371 (c)(1), (2), (4) Date: Jul. 11, 2007

(87) PCT Pub. No.: WO2005/061857

PCT Pub. Date: Jul. 7, 2005

(65) Prior Publication Data

US 2008/0289336 A1 Nov. 27, 2008

(30) Foreign Application Priority Data

| | | |
|---|---|---|
| Dec. 22, 2003 | (DE) | 103 60 364 |
| Dec. 22, 2003 | (DE) | 103 60 379 |
| Dec. 22, 2003 | (DE) | 103 60 380 |
| Dec. 24, 2003 | (DE) | 103 61 203 |
| Dec. 24, 2003 | (DE) | 103 61 223 |

(51) Int. Cl.
*F01K 25/06* (2006.01)
*F01K 25/08* (2006.01)
*F01K 25/00* (2006.01)

(52) U.S. Cl. ..... 60/673; 60/649; 60/651; 60/671

(58) Field of Classification Search ..... 60/649, 60/671, 673, 651
See application file for complete search history.

(56) References Cited

U.S. PATENT DOCUMENTS

| | | | | |
|---|---|---|---|---|
| 3,505,810 A | | 4/1970 | Mamiya | |
| 4,009,575 A | * | 3/1977 | Hartman et al. | 60/648 |
| 4,195,485 A | * | 4/1980 | Brinkerhoff | 60/649 |
| 4,295,335 A | * | 10/1981 | Brinkerhoff | 60/673 |
| 4,307,572 A | * | 12/1981 | Brinkerhoff | 60/649 |
| 4,534,175 A | * | 8/1985 | Kogan et al. | 60/649 |

(Continued)

FOREIGN PATENT DOCUMENTS

DE 197 12 325 10/1998

(Continued)

OTHER PUBLICATIONS

International Preliminary Report on Patentability of International Application No. PCT/EP2004/053650.

*Primary Examiner*—Thomas E Denion
*Assistant Examiner*—Christopher Jetton
(74) *Attorney, Agent, or Firm*—Cohen Pontani Lieberman & Pavane LLP

(57) ABSTRACT

A method for converting heat energy to mechanical energy includes expanding an evaporated working fluid with an expansion device connected to an evaporator. The expansion is carried out in a low-pressure expansion device and the energy contained in the expanded evaporated working fluid can be recycled into the evaporator and utilized for evaporating additional working fluid.

29 Claims, 2 Drawing Sheets

U.S. PATENT DOCUMENTS

| | | | | |
|---|---|---|---|---|
| 4,622,820 | A * | 11/1986 | Sundquist | 60/673 |
| 4,848,088 | A * | 7/1989 | Lazarevich | 60/673 |
| 6,237,340 | B1 * | 5/2001 | Kim | 60/649 |
| 7,019,412 | B2 * | 3/2006 | Ruggieri et al. | 290/2 |
| 2003/0172654 | A1 * | 9/2003 | Lawheed | 60/641.8 |

FOREIGN PATENT DOCUMENTS

| | | |
|---|---|---|
| FR | 1 546 326 | 12/1967 |
| JP | 61171811 | 8/1986 |

* cited by examiner

APPARATUS AND METHOD FOR CONVERTING HEAT ENERGY TO MECHANICAL ENERGY

CROSS REFERENCE TO RELATED APPLICATIONS

This is a U.S. national stage of application No. PCT/EP2004/053650, filed on 22 Dec. 2004. Priority is claimed on the following application(s): Country: Germany, Application No.: 103 60 380.8, Filed: 22 Dec. 2003; Country: Germany, Application No.: 103 60 379.4, Filed: 22 Dec. 2003; Country: Germany, Application No.: 103 60 364.6, Filed: 22 Dec. 2003; Country: Germany, Application No.: 103 61 203.3, Filed: 24 Dec. 2003; and Country: Germany, Application No.: 103 61 223.8, Filed: 24 Dec. 2003, the contents of which are incorporated here by reference.

BACKGROUND OF THE INVENTION

The present invention relates to a method of converting heat energy to mechanical energy by expanding an evaporated working fluid by an expansion means connected to an evaporator.

A great number of devices and methods for obtaining mechanical energy are known from the state of the art. For example, heat engines are known, in which a working fluid, such as water vapor is isobarically heated at a high pressure up to the boiling point in a boiler, evaporated and then superheated in a superheater. Subsequently the vapor is adiabatically expanded in a turbine doing work and condensed in a condenser giving off heat. The liquid is pressurized by a feed-water pump and fed back into the boiler. One of the drawbacks of this device is that during the expansion process in turbines high pressures of more than 15 to 200 bar have to be generated since in turbines the pressure ratio of the expansion is essential for the efficiency to be reached.

Another feature of the prior art expansion processes for converting heat energy to mechanical energy is that the condensation waste heat generated in the condensation of the working fluid is disadvantageous waste heat for the expansion process itself, which negatively affects efficiency.

SUMMARY OF THE INVENTION

It is therefore an object of the present invention to provide a method and an apparatus for converting heat energy to mechanical energy while avoiding the above drawbacks, in particular to provide an improved efficiency, especially with low temperature and pressure levels.

According to the invention it is provided that expansion occurs in a low-pressure expansion device and the energy contained in the expanded evaporated working fluid can be recycled into the evaporator, which can be utilized for evaporating additional working fluid. Preferably the method comprises a first component of the working fluid formed by a mixture which is absorbed in and/or downstream of the low-pressure expansion device by means of an absorption fluid, wherein heat is transferred to the remaining evaporated second component, which can be recycled. In one embodiment of the invention, the mixture is azeotropic at a given mixing ratio of the components and has a minimum boiling point. Depending on the type of azeotropically evaporating mixtures with a minimum boiling point, the vaporization temperatures can be lowered so that they are below the condensation temperatures of the individual components. If the first component is adiabatically absorbed from the vapor mixture, the corresponding heat is transferred to the second component remaining evaporated. The withdrawal of the condensation heat can therefore be carried out at a higher temperature level. In particular, with a suitably selected azeotropic mixture, the second evaporated component can be condensed in the evaporator of the working fluid itself while giving off condensation heat, so that the corresponding percentage of the heat energy can be recycled into the process. If the first component to be absorbed is water, an alkaline silicate solution can be used as the absorption fluid, for example.

The working fluid, for example, an azeotropic mixture of water and perchloroethylene can be evaporated, for example, by means of heat exchange with primary energy from process vapors or heated process liquids and/or heat stores. The absorption, during which according to the present invention the absorption heat generated is transferred to the second component remaining evaporated, thereby heating this component to a temperature level above the boiling point of the azeotropic mixture, can be within and/or downstream of the expansion device. One of the essential advantages herein is that by expanding the azeotropic mixture, mechanical energy can be obtained in the generator and, at the same time, the expanded working fluid which has already "done work" in the expansion process, is heated by means of the separation (absorption) of the first from the second component due to the generation of absorption heat. Herein the remaining working fluid can be recycled after expansion, for example, to give off its heat in a heat exchanger. In one embodiment of the invention it is possible, for example, that the remaining working fluid (second component only) is passed into a heat exchanger (evaporator) in which the remaining working fluid is condensed and, due to the generated condensation heat, the liquid working fluid is evaporated with the first and the second component and subsequently recycled into the expansion device. In this manner, according to the present invention, the efficiency of the method for converting heat energy to mechanical energy can be substantially improved.

The working fluid is preferably formed by an azeotropic mixture with a minimum boiling point, or by a nearly azeotropic mixture. In the following the present invention will be described with reference to an azeotropic mixture, although the present invention can, of course, also relate to nearly azeotropic mixtures or non-azeotropic mixtures. High efficiencies can be achieved in particular with an azeotropic or near azeotropic mixture. Depending on the type of azeotropic mixture used, evaporation temperatures can be lowered, so that they are below the evaporation temperatures of the individual components.

In a preferred embodiment the working fluid has a low volume-specific or low molar evaporation enthalpy. It is thus possible to achieve the generation of a great amount of drive vapor with a given amount of heat energy.

Preferably the working fluid is a solvent mixture containing organic and/or inorganic solvent components. These can be, for example, mixtures of water and selected silicones. Preferably at least one component may be a protic solvent.

In an alternative embodiment the absorption fluid is a reversibly immobilizable solvent which, in the non-immobilized aggregate state, is the first component of the working fluid. The reversible solvent in the boiling working fluid can change advantageously by means of physico-chemical changes in such a way that it can be changed from the non-immobilized state to the reversibly immobilized state by ionizing or complex formation from the vapor phase, and can act as an absorption fluid for the working fluid in the non-immobilized form. This is how the evaporated working fluid already contains the absorption fluid (in the non-immobilized state) prior to expansion. The reversibly immobilized solvent is in an evaporated aggregate state and assumes the liquid state by physico-chemical changes, such as pH shift, change of mole fraction and the temperature in its volatility and/or in its vapor pressure (which can be compared to vapor as a solvent in its non-immobilized form and water as a reversibly immobilizable solvent). This is advantageous in that the working fluid consists of two components, wherein the one component in the reversibly immobilized state acts at the same time as an absorption fluid for the other component. Cyclic nitrogen compounds, such as pyridines, can be used, for example, as pH-dependent reversibly immobilizable solvents.

The absorption of the first component can occur, for example, already in the low-pressure expansion device. It is of course also possible that an absorption device, for example formed as a scrubber, is downstream of the low-pressure expansion device. In one possible embodiment the ionization of the reversibly immobilizable solvent can be carried out by means of electrolysis or by the addition of an electrolyte in the absorption device causing the solvent to arise in its immobilized form as an absorption fluid from the working fluid. Simultaneously the vapors of the working fluid passing through the absorption fluid are also ionized so that the vapor pressure is sufficiently lowered for the vapor of the reversibly immobilizable component in the working fluid to precipitate. The azeotropic working fluid is therefore passed through the absorption fluid which takes up (absorbs) the first component, wherein the freed absorption energy is transferred to the evaporated remaining second component. Subsequently the absorption fluid can be recycled into the evaporator where it is transferred into a non-ionized state, for example, by means of deionization and is reevaporated with the condensed phase of the remaining second component as an azeotropic mixture.

Suitably, the mole ratio of the working fluid is selected such that the pressure in the expansion is reduced due to the reduction of the number of molecules remaining in the gaseous phase, as the pressure is increased due to the heating of the remaining gas, so that the establishment of an otherwise resulting counteracting pressure is avoided downstream of the expansion device.

In a further embodiment according to the present invention the expanded evaporated working fluid is brought to a temperature level above the boiling point of the working fluid by means of a heat pump 12. This energy recycling process can therefore be realized by a one-component working fluid. To do this the heat pump 12 is operated with a fluid-overlapped compressor system, such as a fluid-ring pump or a rotary screw compressor, and a working liquid is used for the operation of the heat pump 12 having a molar evaporation enthalpy which contributes a multiple, preferably more than a quadruple, particularly preferably more than a quintuple of the evaporation enthalpy of the working fluid for expansion. According to the present invention, a surplus of the energy recycling is achieved via the driving energy of the heat pump 12.

An apparatus can be used as the low-pressure expansion device, wherein neither the mass of the vapor nor the pressure ratio, but solely the pressure differential is relevant.

In a particularly preferable embodiment, the low-pressure expansion device is a roots blower (roots pump/roots rotary positive blower), as a roots blower or in the form of a lobed impeller pump. It is advantageous that the roots blower can work as an expansion device (expansion motor) with a pressure differential of as little as 500 mbar at its full efficiency, and can be used with pressures between 10 and 0.5 bar in a closed system. According to the invention the roots blower can be formed with at least one injection opening through which the absorption fluid and/or a protic solvent can be introduced into the roots blower. Advantageously the injection is pressure-controlled to avoid fluid damage. Another advantage is that in the above expansion devices, only the pressure differential is critical for the efficiency rather than the mass or the expansion ratio.

Suitably, the roots blower has a gas-tight gasket between the suction chamber and the drive chamber wherein, in a further embodiment, the roots blower has multi-blade rotors.

The roots blower also has a shaft which can be coupled to a generator such that the mechanical energy can be converted to electric energy. The use of a roots blower as a low-pressure expansion device makes it possible, in particular when using waste heat at a temperature of less than about 100° C. for driving pumps or generators, for example, to support on the one hand the process by injecting absorption fluids and on the other to raise the condensation energy of the working fluid, such as by means of a heat pump, back to a raised temperature level due to the low pressure and temperature differentials.

In another embodiment of the present invention, a separating assembly can be provided for separating the absorbed first component from the absorption fluid. The separating assembly can be formed as a membrane system, for example, which is downstream of the absorption device. The desorbed liquid first component is suitably recycled into the evaporator, in which it is evaporated with the second liquid component together as an azeotropic working fluid. The absorption fluid can be fed to the expansion device, for example, in which it is injected into the expanding working fluid. In a further alternative the absorption fluid can be recycled into the scrubber, in which the absorption of the first component from the working fluid is carried out. Absorption fluids can be oils from which the first component of the working fluid can be completely extracted, such as by means of a membrane system.

The separation of the first absorbed component in the absorption fluid can be carried out alternatively by means of a vaporization process of the absorbed component.

Preferably the second component remaining downstream of the absorption device, which has taken up heat due to the absorption despite the expansion, is fed into a heat exchanger and condensed. The heat exchanger is preferably an evaporator in which the first and second components are evaporated as working fluids.

Preferably the working fluid is an azeotropic mixture of water and silicone. The water herein is the first, absorbing component and silicone the second component. Suitably the absorption fluid is a silicate. Advantageously the absorption fluid is an alkaline molecularly disperse silicate solution, wherein the water absorbed in the alkaline silicate solution is desorbed, for example, by heating.

According to the present invention, the present specification relates to a system having an evaporator in which a working fluid formed as a mixture, preferably an azeotropic mixture, is vaporizable, a low-pressure expansion device, an absorption device integrated with the low-pressure expansion device and/or downstream of the low-pressure expansion device, wherein a first component of the working fluid can be absorbed by an absorption fluid and heat can be transferred to the remaining, evaporated second component, which is recyclable, in the absorption device.

BRIEF DESCRIPTION OF THE DRAWINGS

Further advantages, features and details of the present invention can be derived from the following description of exemplary embodiments of the invention in detail with reference to the accompanying drawings. The features mentioned in the claims and the description can be essential for the present invention singly or in any combination. In the figures:

DETAILED DESCRIPTION OF THE PREFERRED EMBODIMENTS

Figure 1:
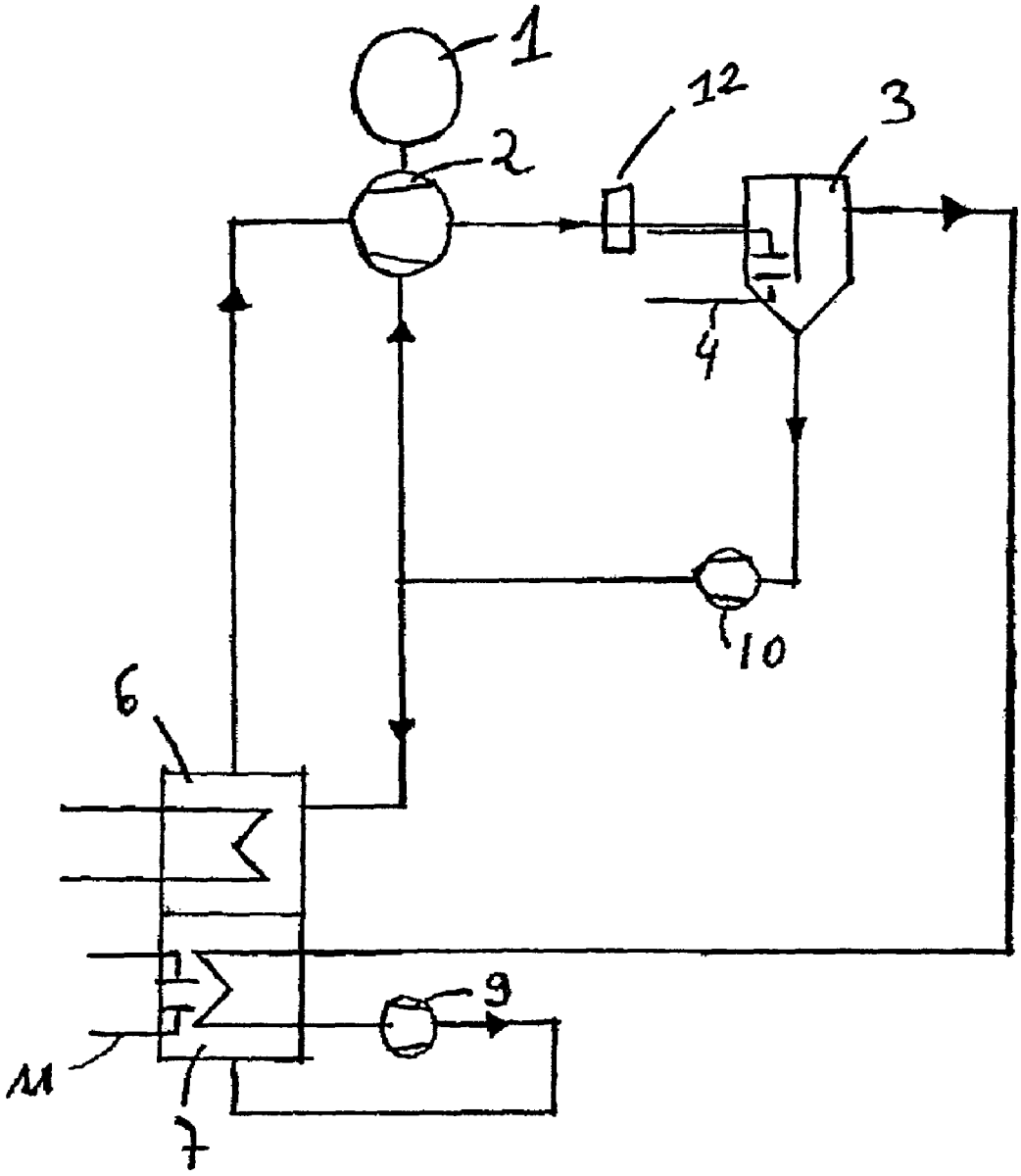
FIG. 1 is a schematic diagram showing a system for transforming heat energy to mechanical energy.

FIG. 1 shows a system, in which an evaporator 6 evaporates a working fluid. The working fluid is expanded in a low-pressure expansion device 2, wherein mechanical energy is generated or work is done. The expansion device 2, which in the present embodiment is formed as a roots blower 2, is coupled to a generator 1 which it drives, so that electric energy can be generated. The working fluid is an azeotropic mixture with first and second components. The working fluid is a solvent mixture, wherein the first component of the solvent mixture is reversibly immobilizable. This component is contained in the working fluid evaporated in the non-immobilized form. This means that the present system is operated with a working fluid which only has two components, wherein the first component in its immobilized form is at the same time the absorption fluid.

The working fluid is, for example, a mixture of pyridine and water. The boiling point of pyridine is at 115° C., the one of water at 100° C. The azeotropic mixture (pyridine 57%, water 43%) boils at 92.6° C. Pyridine is not immobilized in an alkaline environment and can be evaporated in this state, it is, however, immobilized in an acidic environment, i.e. it has no vapor pressure and can therefore be used as an absorption fluid.

Roots blower 2 is formed with injection openings so that, during the operation of the system, the absorption fluid can be introduced in its liquid, reversibly immobilized form into the evaporated working fluid. In the process, part of the first component is absorbed by the absorption fluid during the expansion process within roots blower 2. In the downstream absorption device 3, which is formed as a separator, the expanded working fluid is further absorbed. Absorption device 3, which in another embodiment can also be formed as a scrubber, has an electrolysis device 4 which maintains the precipitation of the vapor of the reversibly immobilizable first component in the absorption fluid.

It is particularly advantageous that the working fluid is an azeotropically evaporating mixture in which, depending on the type, the evaporating temperature can be lowered, so that it is below the condensation temperatures of the individual components. If the first component of the evaporated working fluid is adiabatically absorbed, the heat corresponding to the decrease in entropy is transferred to the remaining second component. This is how the remaining, expanded working fluid is heated despite the expansion, so that a certain percentage of the heat of the working fluid remaining evaporated can be transferred to evaporator 6 via a heat exchanger 7 which results in the efficiency of the system being substantially improved. At the same time absorption device 3 has a liquid separator for separating the remaining vapor of the working fluid from the liquid absorbed component.

The condensed working fluid containing the second component is fed back into the evaporating chamber of evaporator 6 via a pump 9. Simultaneously, the liquid first component (in its reversibly immobilizable form) also passes into the evaporating chamber of evaporator 6 by means of pump 10, where it is brought back into its non-ionic, non-immobilized state by means of an electrochemical treatment 11, and therefore reevaporates with the condensed first component.

Figure 2:
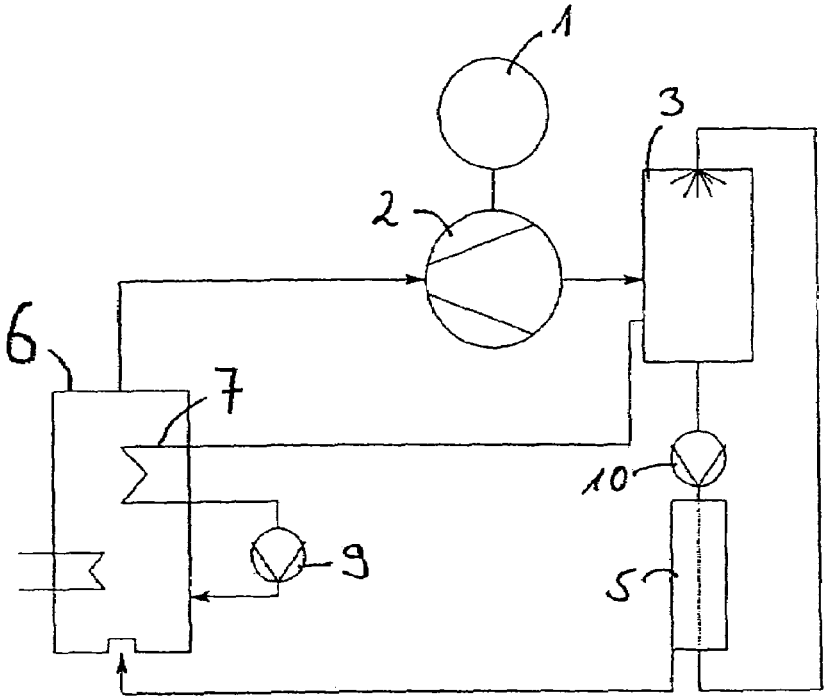
FIG. 2 is a schematic diagram of a further embodiment of a system for transforming heat energy to mechanical energy.

FIG. 2 shows a further alternative of the system of the present invention with an evaporator 6 in which working fluid is evaporated.

The working fluid is a mixture of water and silicone in an azeotropic mixture (5% water, 95% silicone). The boiling point of water is 100° C., the boiling point of silicone is 110° C. The boiling point of the azeotropic mixture is at below 80° C. The absorption fluid for the water is an alkaline silicate solution.

The azeotropic working fluid is fed to roots blower 2 and expanded, wherein energy is obtained at the shaft of roots blower 2, which is used to generate electric current by means of a generator 1. In another embodiment roots blower 2 can have injection openings through which an absorption fluid is injected.

An absorption device 3, which is formed as a scrubber 3, in which the evaporated working fluid is separated from the absorption fluid, is downstream of the expansion. Herein the first component is absorbed by the absorption fluid. According to the embodiment of FIG. 1, the second, remaining component is heated by the absorption process, wherein the second component is condensed in a heat exchanger 7 within evaporator 6. A pump 9 feeds the liquid second component back into evaporator 6. The heat generated by the condensation in heat exchanger 7 can therefore be further used in evaporator 6 for evaporating the working fluid of the first and second components.

The absorbed first component with the absorption fluid is passed into a separating assembly 5 via a pump 10 where the absorption fluid is separated from the first component by thermal desorption. Downstream of separating assembly 5 the absorption fluid is reinjected into scrubber 3, wherein the liquid first component is introduced into vaporization chamber 6. Since the azeotropic mixture boils at a lower temperature than its individual components the heat transferred to evaporator 6 due to the condensation in heat exchanger 7 can contribute, as in the exemplary embodiment of FIG. 1, to evaporate the working fluid and so to improve the efficiency of the overall system.

Figure 3:
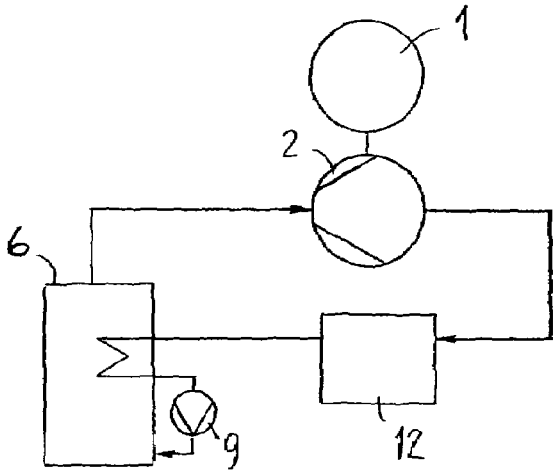
FIG. 3 is a schematic diagram of vet another embodiment of system for transforming a heat energy to mechanical energy.

In a further embodiment shown in FIG. 3, the expanded evaporated working fluid is brought to a temperature level above the boiling point of the working fluid by a heat pump 12. In this embodiment, energy recycling may be realized with a one component working fluid. An operating liquid of the heat pump has an evaporation enthalpy greater than quadruple the evaporation enthalpy of the working fluid. The heat is recycled using the heat exchanger 7 as in the previous embodiments.

What is claimed is:

1. A method of transforming heat energy to mechanical energy, comprising the steps of:

expanding an evaporated working fluid using a low-pressure expansion device connected with an evaporator to form an expanded evaporated working fluid, and recycling energy contained in the expanded evaporated working fluid into the evaporator such that the recycled energy is utilized to evaporate additional working fluid, wherein the working fluid is an azeotropic mixture.

2. The method of claim 1, wherein the working fluid is a mixture including a first component and a second component, said method further comprising absorbing, by an absorption fluid, a portion of the first component at least one of in or downstream of the low-pressure expansion device, and transferring recyclable heat to the remaining evaporated second component during said step of absorbing.

3. The method of claim 2, wherein the mixture is an azeotropic mixture that has a minimal boiling point at a certain mixing ratio.

4. The method of claim 3, wherein the heat transferred to the second component in said step of transferring heats the second component remaining evaporated to a temperature above the boiling point of the mixture, and wherein said step of transferring recyclable heat comprises condensing the second component in a heat exchanger.

5. The method of claim 1, further comprising transforming the expanded, evaporated working fluid to a temperature level above the boiling point of the working fluid by a heat pump.

6. The method of claim 5, wherein the heat pump comprises a liquid-overlapped compressor system.

7. The method of claim 6, wherein the compressor system is formed as a fluid-ring pump or as a liquid-overlapped rotary screw compressor.

8. The method of claim 5, wherein the evaporation enthalpy of the operating fluid of the heat pump is greater than the quadruple of the evaporation enthalpy of the working fluid.

9. The method of claim 1, wherein the working fluid has a low volume-specific evaporation enthalpy.

10. The method of claim 1, wherein the working fluid is a solvent mixture comprising organic and/or inorganic solvent components.

11. The method of claim 10, wherein at least one component of the working fluid is a protic solvent.

12. The method of claim 2, wherein the absorption fluid is a reversibly immobilizable solvent which, in its non-immobilized aggregate state, is the first component of the working fluid.

13. The method of claim 1, wherein the low-pressure expansion device is a roots blower.

14. The method of claim 13, wherein the roots blower is provided with at least one injection opening, said method comprising the step of introducing one of an absorption fluid and a protic solvent into the roots blower through the at least one injection opening.

15. The method of claim 2, wherein the first component is absorbed in an absorption device arranged downstream of the low-pressure expansion device.

16. The method of claim 15, wherein the absorption device is as a scrubber.

17. The method of claim 15, wherein the absorption device comprises an electrolysis device.

18. The method of claim 2, further comprising the step of separating the absorbed first component from the absorption fluid using a separating assembly.

19. The method of claim 18, wherein the separating assembly is a membrane system.

20. The method of claim 18, wherein said step of separating comprises evaporating the absorbed first component.

21. The method of claim 1, wherein the evaporator is arranged upstream of the low-pressure expansion device to absorb the working fluid.

22. The method of claim 16, further comprising the step of separating the absorbed first component from the absorption fluid using a separating assembly and feeding, by a pump, the absorption fluid into the separating apparatus and subsequently back to the scrubber.

23. The method of claim 1, wherein the working fluid is an azeotropic mixture of water and silicone.

24. The method of claim 1, wherein the absorption fluid is a silicate solution.

25. A system for transforming heat energy to mechanical energy, comprising:

an evaporator for evaporating a working fluid formed as a mixture comprising first and second components;

a low-pressure expansion device receiving the evaporated working fluid and expanding the evaporated working fluid;

an absorption device that is one of integrated with the low-pressure expansion device and downstream of the low-pressure expansion device, the absorption device introducing an absorption fluid to the working fluid, wherein the first component of the working fluid is absorbed by the absorption fluid in the absorption device and heat is transferred to the remaining, evaporated second component, the heat being recyclable, wherein the working fluid is an azeotropic mixture.

26. The system of claim 25, wherein the low-pressure expansion device is a roots blower.

27. The system of claim 25, further comprising a separating assembly separating the absorbed first component from the absorption fluid.

28. The system of claim 25, further comprising a generator coupled to the low-pressure expansion device for converting the mechanical energy to electric energy.

29. The system of claim 25, wherein said evaporator is arranged and dimensioned for recycling energy contained in the expanded evaporated working fluid such that the recycled energy is utilized to evaporate additional working fluid.

* * * * *